United States Patent [19]

Navarre

[11] 4,432,518

[45] Feb. 21, 1984

[54] EAVES TROUGH BRACKET ASSEMBLY

[76] Inventor: Robert J. Navarre, Rte. 2, Box 89, Harrah, Okla. 73045

[21] Appl. No.: 439,936

[22] Filed: Nov. 8, 1982

[51] Int. Cl.[3] ..... E04D 13/06

[52] U.S. Cl. ..... 248/48.2; 52/11

[58] Field of Search ..... 248/48.2, 48.1; 52/11, 52/12, 94, 95, 96

[56] References Cited

U.S. PATENT DOCUMENTS

| | | | |
|---|---|---|---|
| 2,271,081 | 1/1942 | Layton | 248/48.2 |
| 3,752,428 | 8/1973 | Trostle et al. | 248/48.2 |
| 4,241,548 | 12/1980 | Rowe | 248/48.2 |

*Primary Examiner*—William H. Schultz
*Assistant Examiner*—Ramon O. Ramirez
*Attorney, Agent, or Firm*—Robert M. Hessin

[57] ABSTRACT

A dually adjustable eaves trough bracket for installation of eaves trough at varying angles to roof rafter and eaves board structure. The bracket including a securing plate adapted for vertical orientation to the roof eave structure and including a plurality of brace slots, and further including a trough support member for interlocking connection to the upper end of the securing plate as an adjustably positionable brace plate supports the trough support member relative to the securing plate brace slots at a proper drainage attitude.

6 Claims, 4 Drawing Figures

EAVES TROUGH BRACKET ASSEMBLY

BACKGROUND OF THE INVENTION

1. Field of the Invention

The invention relates generally to roof troughing fixtures and, more particularly, but not by way of limitation, it relates to an improved form of eaves trough bracket that is adjustable as to angle of affixure while providing proper and level trough support.

2. Description of the Prior Art

The prior art includes numerous types of bracket member which simply strap from the roof member into support of the upper edges of the eaves trough or gutter member. Still other prior support brackets are utilized in vertically perpendicular affixure, and such brackets require additional finishing to the eave ends of the roof rafters, either by a vertical saw cut or by super positioning of a wedge member thereby to provide the necessary attaching vertical surface. In large part, prior art forms of support and bracket structure for eave troughs have been of static, fixed construction with little or no adjustability to allow for variations in roof eave angularity and structure.

SUMMARY OF THE INVENTION

The present invention relates to improvements in construction of roof eave trough brackets, such improvements being largely directed to adjustability and general adaptability for use in varying installations. The bracket consists of a securing plate that is adapted to be secured generally vertically to the roof eave structure while presenting an upper retaining hook structure and a lower end that exposes a plurality of brace slots. A trough support member, adapted to tightly receive conventional forms of guttering includes interlock hooks for engagement with the securing plate retaining hook as a lower brace plate is adjustably secured between a selected brace slot and the trough support member to maintain the eaves trough in proper operative attitude.

Therefore, it is an object of the present invention to provide a versatile and adaptable eaves trough bracket which can be utilized in various applications adapting to the exigencies of the particular structure.

It is also an object of the present invention to provide a trough bracket which can be attached to roof eave structure without requiring additional finishing wood work.

Finally, it is an object of the present invention to provide a simple but rugged bracket structure that is fully adaptable for various roof eave installations.

Other objects and advantages of the invention will be evident from the following detailed description when read in conjunction with the accompanying drawings which illustrate the invention.

DETAILED DESCRIPTION OF THE INVENTION

Figure 1:
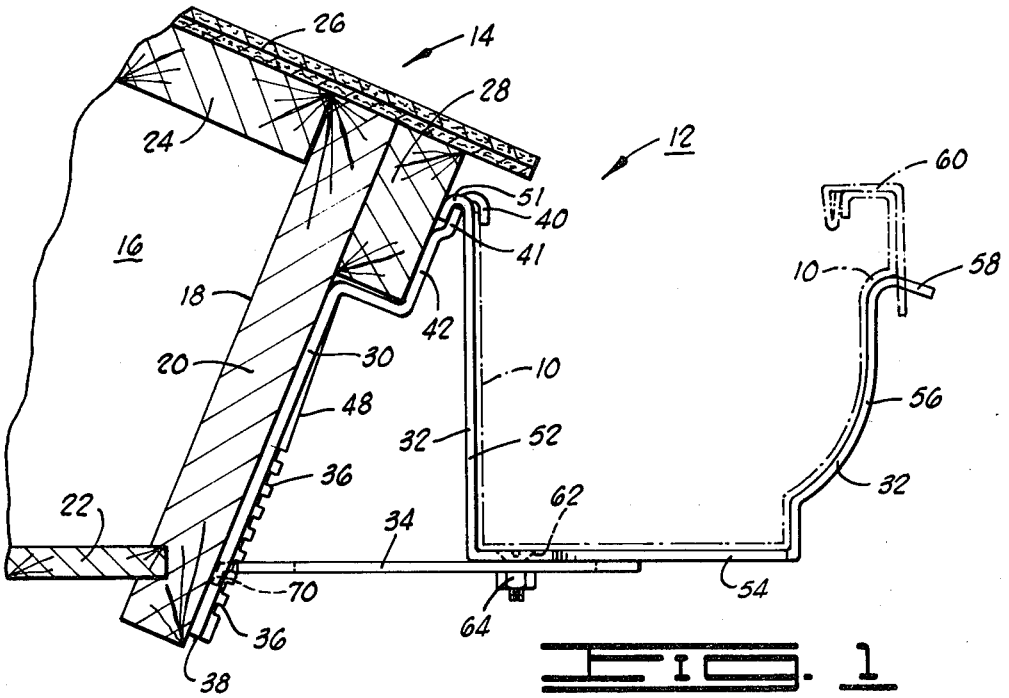
FIG. 1 is a vertical section showing the bracket structure of the invention in operative affixure on a roof eave structure.

FIG. 1 illustrates a roof gutter or eaves trough 10 (dashlines), as it would be supported by a bracket 12 from roof eave structure 14. Thus, in accordance with today's form of eaves finishing, the rafters 16 are left with unfinished butt end 18 upon which an eaves board 20 is affixed. A soffit panel 22 is then secured horizontally to extend to the outer surface of the wall structure. Roof stripping or paneling 24 is then secured across the upper surface of rafters 16 to receive overlay of shingle structure 26. In many of today's construction methods, sealing strip 28 is secured along the outer, upper edge of eaves board 20 beneath the edge of shingle surface 26.

Figure 3:
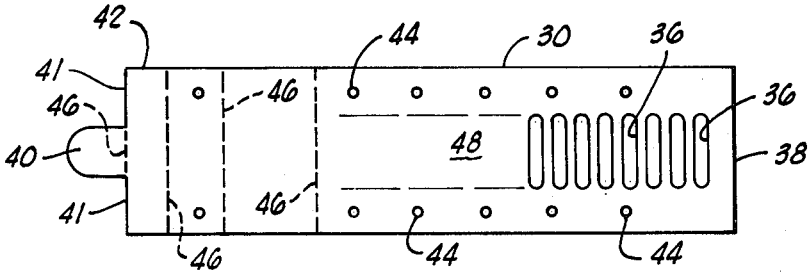
FIG. 3 is a plan view of a securing plate in layout.

The bracket 12 consists of three major components, a securing plate 30, a trough support member 32 and a brace plate 34. The bracket 12 is installed with securing plate 30 secured as by screw fasteners (not shown) to the eaves board 20 and, if present, the sealer strip 28. Securing plate 30 of generally elongate rectangular form, includes a plurality of selectable brace slots 36 disposed along its lower end 38, and it extends retaining hook 40 between opposite transverse shoulders 41 at its upper end 42. See also FIG. 3 which illustrates the securing plate 30 in layout indicating the bend lines 46 by dash-line. Thus, securing plate 30 includes a plurality of fastener holes 44 which may be utilized as desired in securing plate 30 to eaves board 20. The bend lines 46 of FIG. 3 conform to the bends of securing plate 30 as depicted in the side view of FIG. 1. A planar indentation is formed at area 48 along brace slots 36 to enable clearance behind the brace slots 36 and adjacent eaves board 20.

Figure 2:
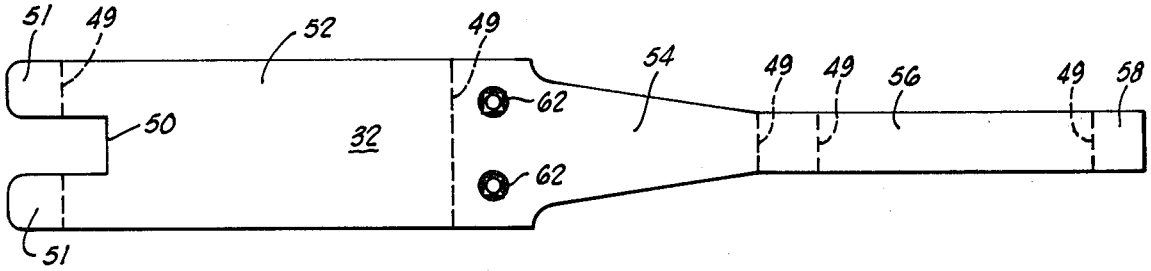
FIG. 2 is a plan view of a trough support member in layout.

Referring to FIGS. 1 and 2, the trough support member 32 is formed of sheet metal as shown in layout in FIG. 2. Member 32 is further formed along the plurality of transverse bend lines 49 to the formation shown in FIG. 1, i.e. consisting of rear panel 52, lower panel 54, and front curved portion 56. The particular cross-sectional configuration, particularly the bent portion 56, is formed to receive a particular configuration of commercial eaves trough 10. Other commercially available troughs have similar but slightly differing cross-section, and the bend configuration of trough support member 32 can be altered accordingly. The rearward end of member 32 is formed to include a longitudinally central slot 50 and opposite side interlock hooks 51 for coaction with retaining hook of securing plate 30. The forward portion of trough support member 32 is formed into a hook 58, exibiting a spring-like quality, which can receive a well known form of spring clip 60 (dash-line) for securing the gutter within bracket 12. Also, it may be noted that the rear edge of gutter 10 secures within retaining hook 40. Finally, a plurality of holes 62 are formed across bottom panel 54 to provide adjustable fastening to brace plate 34 by means of fasteners 64.

Figure 4:
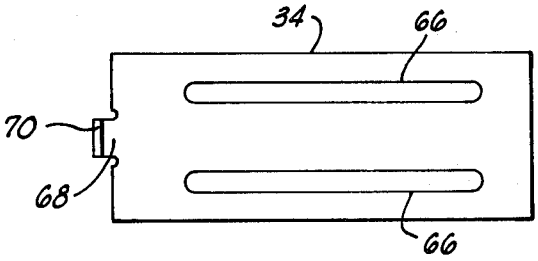
FIG. 4 is a plan view of a brace plate in layout.

The brace plate 34 (FIG. 4) consists of a plate member having parallel, longitudinal slots 66 which receive the fasteners 64 adjustably therealong, this depending upon the angular pitch of eaves board 20 and the selection of brace slot 36. One end of brace plate 34 includes a tongue portion 68 having the end right-angle bent to form a gripping tine 70. Thus, and referring again to FIG. 1, the tine 70 can be interlocked within a selected brace slot 36 during initial installation of bracket 12.

In operation, the bracket 12 can be utilized with an eaves board 20 as finished at any of various angles.

Thus, eaves board 20 attitude may range from perpendicular to angular as when buttfinished to rafters 16 at an angle complementary to the roof pitch. The securing plate is secured by two or more fasteners, e.g. nails, screws or the like, through selected securing holes 44. The trough support member 32 is then positioned by placing hook ends 51 over shoulders 41 of securing plate 30, and swinging the trough support member 32 arcuately downward towards eaves board 20 into locked engagement. Thereafter, the brace plate 34 is installed, selecting an appropriate brace slot 36 for retention of tine 70, by securing fasteners 64 at a position wherein eaves trough 10 is maintained in proper drainage position.

The foregoing illustrates a novel form of eaves trough bracket which enables a multiple of adjustment functions that accomodate many variations in roof construction and gutter shape. The bracket can be fully utilized on eave structures of the older type wherein it is probable that securing attitude will be perpendicular; on the other hand, the bracket is fully adjustable to accept positioning at any of various angular eaves positions and the apparatus is dually adjustable to enable rapid and accurate fitting upon installation.

Changes may be made in combination and arrangement of elements as heretofore set forth in the specification and shown in the drawings; it being understood that changes may be made in the embodiments disclosed without departing from the spirit and scope of the invention as defined in the following claims.

What is claimed is:

1. An eaves trough bracket, comprising:

a securing plate adapted to be secured in generally vertical orientation to roof eave structure, and having a plurality of brace slots adjacent the lower end and a retaining hook on the opposite, upper end;

a trough support member having interlocking hooks formed on one end for retentive engagement with said retaining hook, said member including elongated structure for supporting the eaves trough; and brace plate means secured between one of said securing plate brace slots and said trough support member elongated structure.

2. A bracket as set forth in Claim 1 wherein said securing plate further comprises:

an elongated, generally rectangular plate having a longitudinally central indented portion which includes said plurality of brace slots and enables a planar indentation clearance, and having said retaining hook extending from the opposite upper end while defining planar shoulders on each side thereof.

3. A bracket as set forth in claim 1 wherein said trough support member further comprises:

first and second hooks formed on said one end and defining a longitudinal slot therebetween, with said member being transversely bent-formed to provide elongated structure having shape similar to the cross-section of the eaves trough.

4. A bracket as set forth in claim 2 wherein said trough support member further comprises:

first and second hooks formed on said one end and defining a longitudinal slot therebetween, with said member being transversely bent-formed to provide elongated structure having shape similar to the cross-section of the eaves trough.

5. A bracket as set forth in claim 1 wherein said brace plate means comprises:

rectangular plate means having first and second parallel, longitudinal slots to provide adjustable securing connection to said trough support member, and a tine member on one end for interlocking support within a selected brace slot of said securing plate.

6. A bracket as set forth in claim 1 which includes:

fastener means adjustably secured between said brace plate means and said trough support member to adjust the angle of support of said eaves trough relative to said securing plate.

* * * * *